US008998308B2

(12) United States Patent
Chen

(10) Patent No.: US 8,998,308 B2
(45) Date of Patent: Apr. 7, 2015

(54) FOLDABLE ROCKING CHAIR

(71) Applicant: Te-Lung Chen, Tainan (TW)

(72) Inventor: Te-Lung Chen, Tainan (TW)

( * ) Notice: Subject to any disclaimer, the term of this patent is extended or adjusted under 35 U.S.C. 154(b) by 63 days.

(21) Appl. No.: 13/900,719

(22) Filed: May 23, 2013

(65) Prior Publication Data

US 2014/0232154 A1 Aug. 21, 2014

(30) Foreign Application Priority Data

Feb. 21, 2013 (TW) ..... 102203294 U

(51) Int. Cl.

| | |
|---|---|
| ***A47C 3/02*** | (2006.01) |
| ***A47C 3/025*** | (2006.01) |
| ***A47C 3/026*** | (2006.01) |
| ***A47C 4/44*** | (2006.01) |

(52) U.S. Cl.

CPC ..... *A47C 3/02* (2013.01); *A47C 3/0255* (2013.01); *A47C 3/026* (2013.01); *A47C 4/44* (2013.01)

(58) Field of Classification Search

USPC ..... 297/271.1, 271.3, 258.1, 261.4, 32, 33

See application file for complete search history.

(56) References Cited

U.S. PATENT DOCUMENTS

| | | | | |
|---|---|---|---|---|
| 3,047,334 | A * | 7/1962 | Vanderminden | 297/39 |
| 5,464,270 | A * | 11/1995 | Chang | 297/81 |
| 7,407,229 | B1 * | 8/2008 | Chen | 297/259.2 |
| 7,950,734 | B2 * | 5/2011 | Zheng | 297/28 |
| 8,177,296 | B2 * | 5/2012 | Shih | 297/85 M |

* cited by examiner

*Primary Examiner* — Sarah B McPartlin

(74) *Attorney, Agent, or Firm* — Alan D. Kamrath; Kamrath IP Lawfirm, P.A.

(57) ABSTRACT

A rocking chair includes a base unit, a frame unit located above the base unit, and a plurality of rocking members mounted between the base unit and the frame unit to connect the base unit and the frame unit. The frame unit is suspended above the base unit and is capable of swinging forward and backward relative to the base unit. The frame unit has an adjustable inclined angle. Thus, the frame unit and the base unit are folded when not in use to reduce the whole volume of the rocking chair.

6 Claims, 14 Drawing Sheets

FOLDABLE ROCKING CHAIR

BACKGROUND OF THE INVENTION

1. Field of the Invention

The present invention relates to a rocking chair and, more particularly, to a foldable rocking chair.

2. Description of the Related Art

A first conventional rocking chair in accordance with the prior art shown in FIG. 1 comprises a stand 51, a seat frame 50 located above the stand 51, and a plurality of links 52 connected between the seat frame 50 and the stand 51. Thus, the seat frame 50 is moved forward and backward relative to the stand 51 by pivoting motion of the links 52. However, the first conventional rocking chair has a fixed structure and cannot be folded when not in use so that it occupies a larger space of storage. In addition, the first conventional rocking chair cannot be carried outdoors.

A second conventional rocking chair in accordance with the prior art shown in FIG. 2 comprises a curved stand 61, and a seat frame 60 mounted on the curved stand 61. Thus, the curved stand 61 is rocked on the ground so that the seat frame 60 is rocked forward and backward by pivoting motion of the curved stand 61. However, the curved stand 61 is located between the seat frame 60 and the ground to directly withstand the weight of the seat frame 60 and a shear stress that is produced during the rocking motion of the seat frame 60 so that the curved stand 61 is easily deformed or worn during a long-term utilization. In addition, when the curved stand 61 is placed and rocked on a smooth ground, the curved stand 61 easily slips during rocking. Further, the second conventional rocking chair has a fixed structure and cannot be folded when not in use so that it occupies a larger space of storage. Further, the second conventional rocking chair cannot be carried outdoors.

A third conventional rocking chair in accordance with the prior art shown in FIG. 3 comprises a curved stand 71, and a foldable seat frame 70 mounted on the curved stand 71. Thus, the curved stand 71 is rocked on the ground so that the seat frame 70 is rocked forward and backward by pivoting motion of the curved stand 71. The seat frame 70 is folded when not in use to facilitate storage of the rocking chair. However, the curved stand 71 is located between the seat frame 70 and the ground to directly withstand the weight of the seat frame 70 and a shear stress that is produced during the rocking motion of the seat frame 70 so that the curved stand 71 is easily deformed or worn during a long-term utilization. In addition, when the curved stand 71 is placed and rocked on a smooth ground, the curved stand 71 easily slips during rocking. Further, when the rocking chair is used outdoors, the curved stand 71 directly touches the ground so that the curved stand 71 cannot be rocked conveniently due to larger friction. Further, only the seat frame 70 is foldable so that the third conventional rocking chair also has a larger volume due to the curved stand 71, thereby causing inconvenience in storage of the third conventional rocking chair.

BRIEF SUMMARY OF THE INVENTION

The primary objective of the present invention is to provide a foldable rocking chair that can be folded and stored when not in use to reduce the whole volume and to save the space of storage.

In accordance with the present invention, there is provided a rocking chair, comprising a base unit, a frame unit located above the base unit, and a plurality of rocking members mounted between the base unit and the frame unit to connect the base unit and the frame unit. The frame unit is suspended above the base unit and is capable of swinging forward and backward relative to the base unit. The frame unit has an adjustable inclined angle.

According to the primary advantage of the present invention, the frame unit is rocked and swung forward and backward relative to the base unit by pivoting motion of the rocking members, thereby providing a comfortable sensation to the user.

According to another advantage of the present invention, the frame unit is suspended above the base unit and will not touch the ground during movement so that the frame unit will not be worn or torn due to a frequent rubbing action.

According to a further advantage of the present invention, the frame unit and the base unit are folded when not in use to reduce the whole volume of the rocking chair so as to facilitate packaging, transpiration and storage of the rocking chair.

According to a further advantage of the present invention, the rocking chair is folded to facilitate the user carrying the rocking chair.

According to a further advantage of the present invention, the inclined angle of the frame unit can be adjusted freely to satisfy the user's practical requirement.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
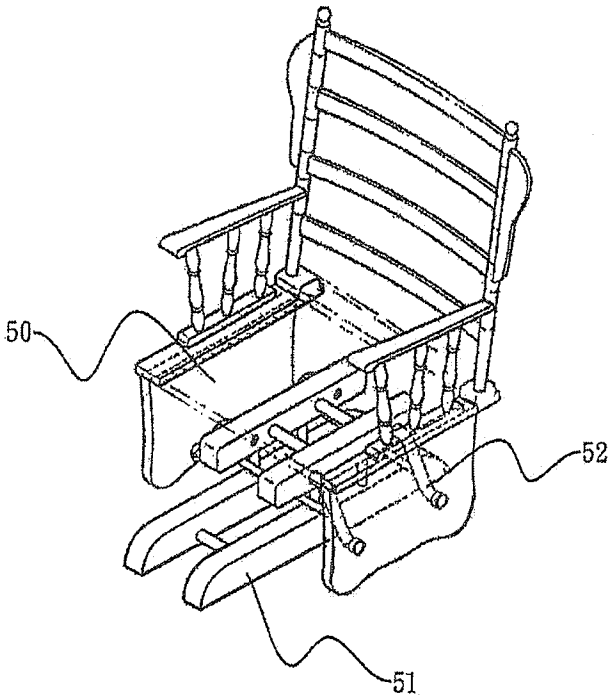
FIG.1 PRIOR ART
FIG. 1 is a perspective view of a first conventional rocking chair in accordance with the prior art.
Figure 2:
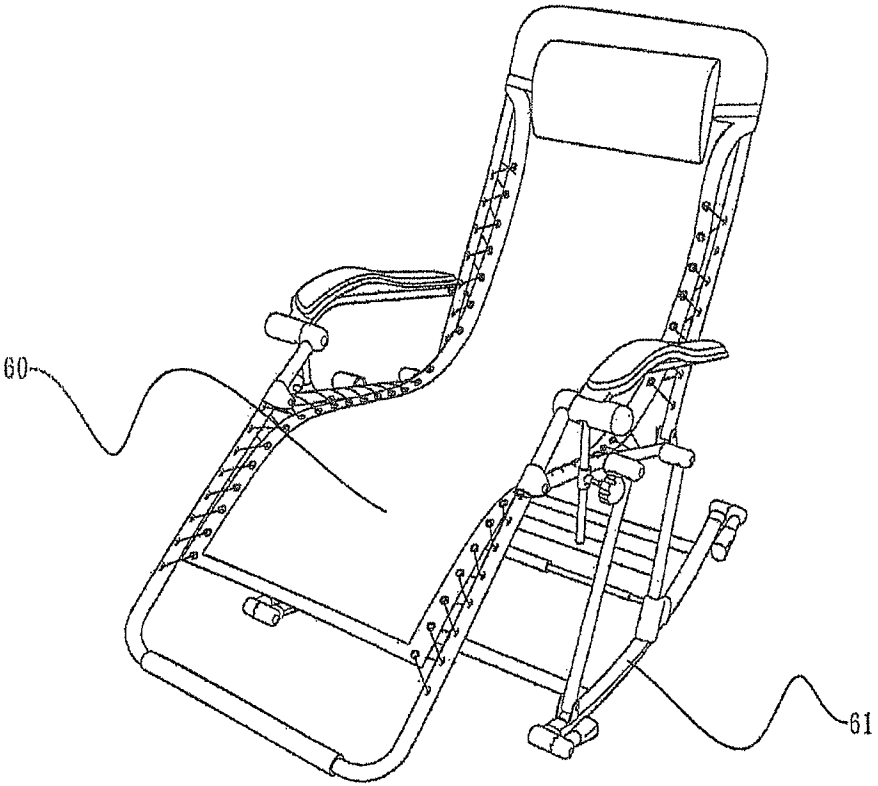
FIG.2 PRIOR ART
FIG. 2 is a perspective view of a second conventional rocking chair in accordance with the prior art.
Figure 3:
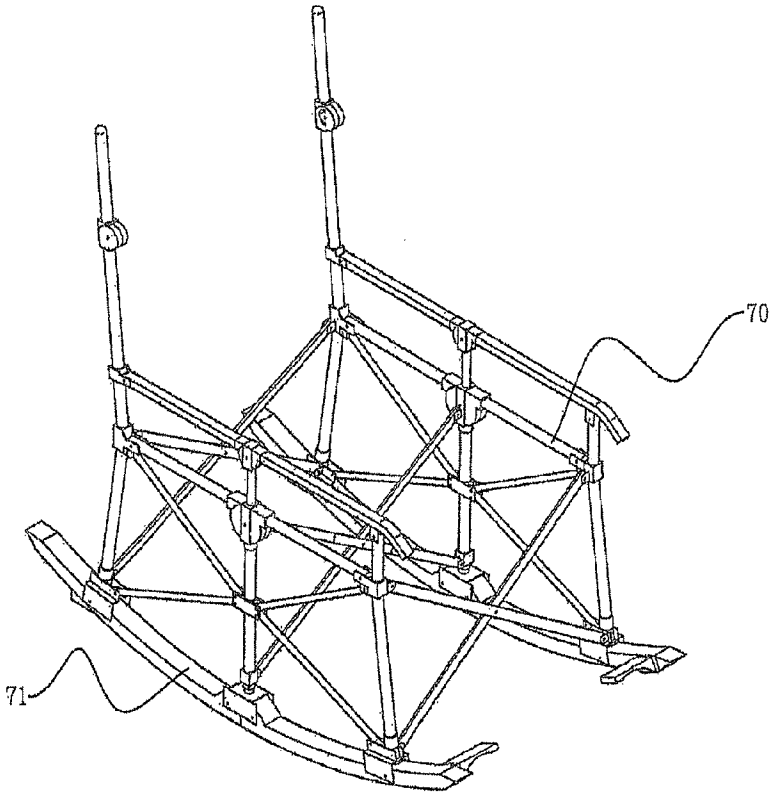
FIG.3 PRIOR ART
FIG. 3 is a perspective view of a third conventional rocking chair in accordance with the prior art.
Figure 4:
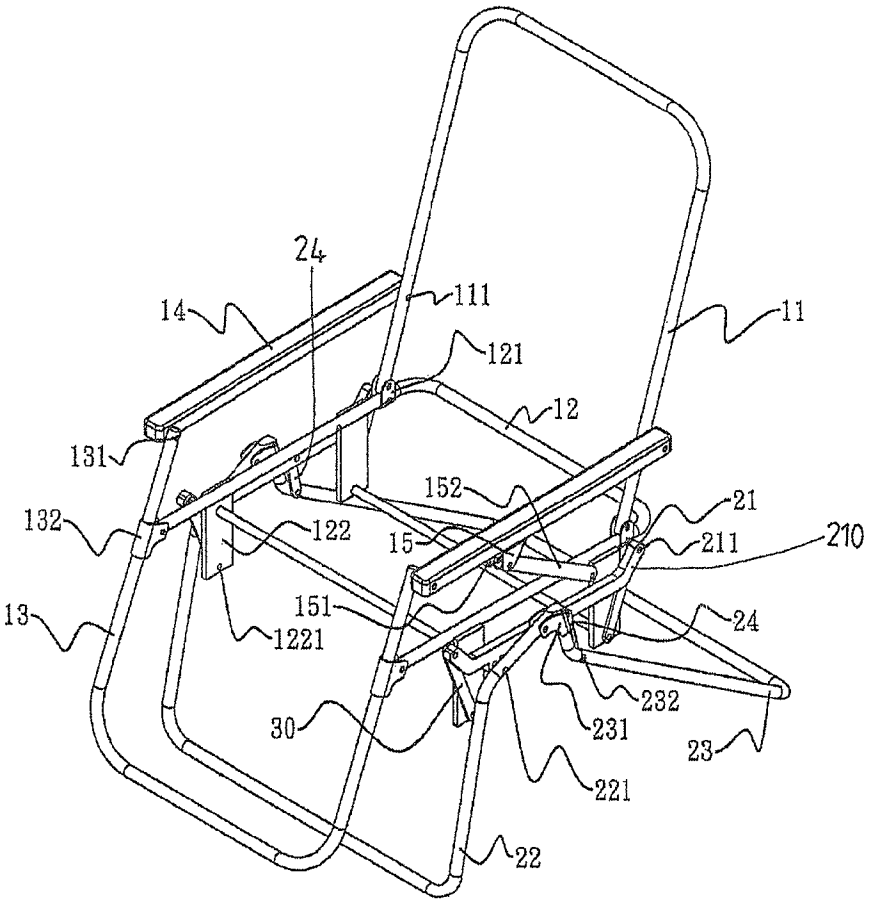
FIG. 4 is a perspective view of a rocking chair in accordance with the preferred embodiment of the present invention.
Figure 5:
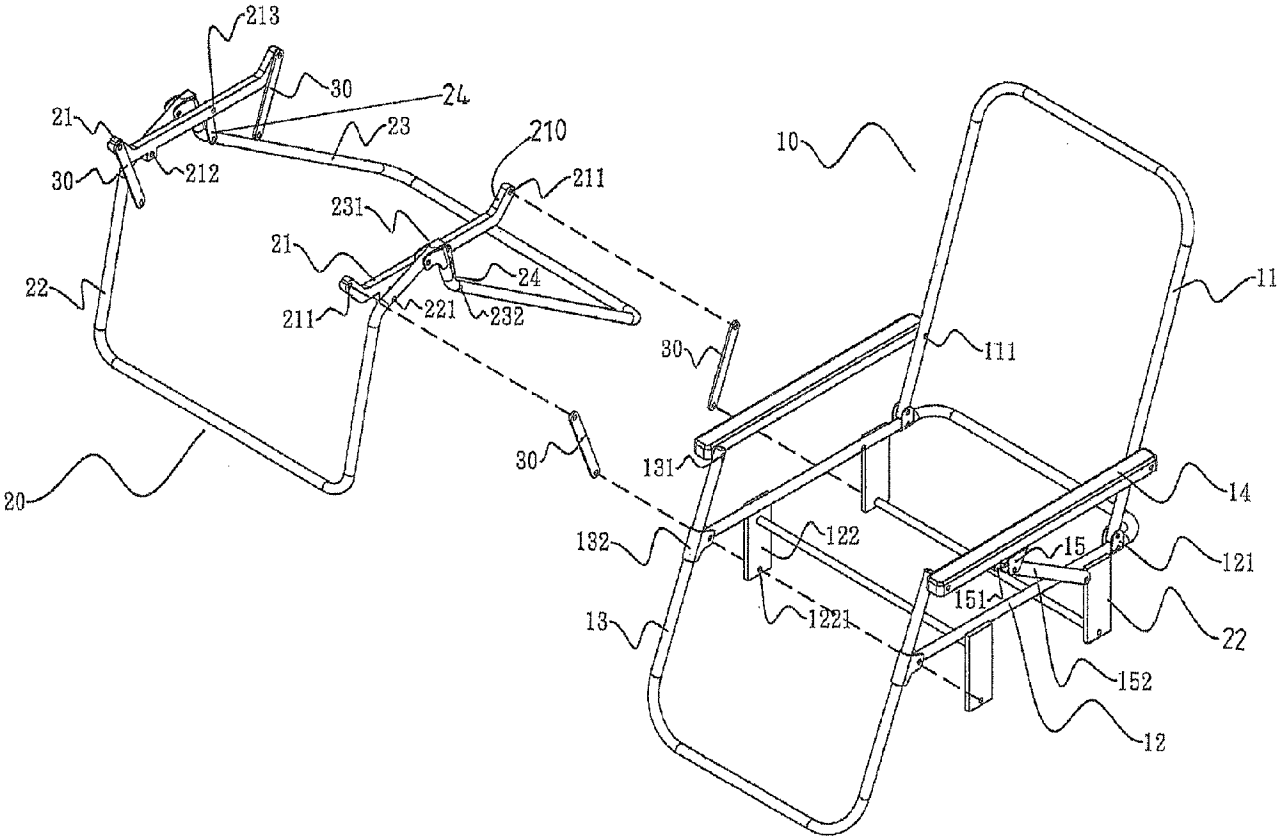
FIG. 5 is a partially exploded perspective view of the rocking chair as shown in FIG. 4.
Figure 6:
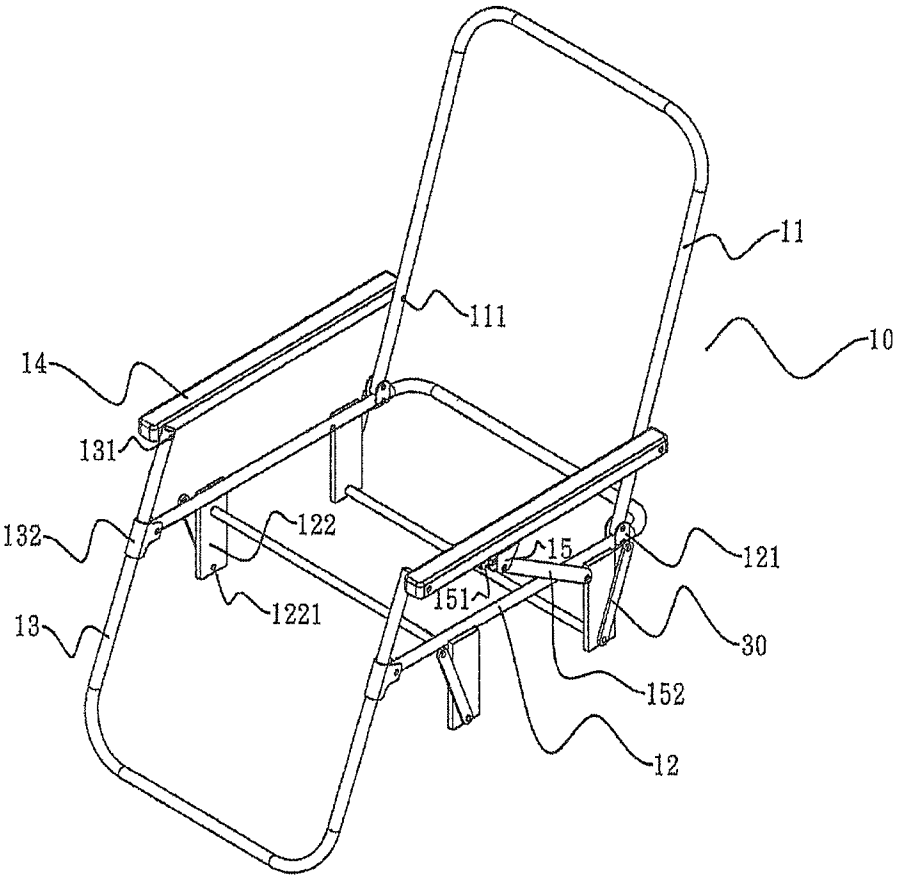
FIG. 6 is a perspective view of a frame unit of the rocking chair as shown in FIG. 4.

Referring to the drawings and initially to FIGS. 4-10, a foldable rocking chair in accordance with the preferred embodiment of the present invention comprises a base unit 20, a frame unit 10 located above the base unit 20, and a plurality of rocking members 30 mounted between the base unit 20 and the frame unit 10 to connect the base unit 20 and the frame unit 10. The frame unit 10 is suspended above the base unit 20 and is capable of swinging forward and backward relative to the base unit 20. The frame unit 10 has an adjustable inclined angle.

The frame unit 10 is spaced from the ground and includes a seat frame 12, a backrest frame 11 connected with the seat frame 12, two first connecting brackets 121 each mounted on the seat frame 12 and each pivotally connected with the backrest frame 11, a footrest frame 13 connected with the seat frame 12, two second connecting brackets 132 each mounted on the footrest frame 13 and each pivotally connected with the seat frame 12, two armrests 14 each connected between the backrest frame 11 and the footrest frame 13, a plurality of extensions 122 each connected with a respective one of the rocking members 30, and a seat mounted on the seat frame 12.

The seat frame 12 of the frame unit 10 has a substantially U-shaped profile. The seat frame 12 of the frame unit 10 is provided with a through hole 126 (see FIG. 7) located in front of one of the first connecting brackets 121. Each of the extensions 122 of the frame unit 10 is a sheet plate and is provided with a first pivot hole 1221. Preferably, each of the extensions 122 of the frame unit 10 is mounted on and extended downward from the seat frame 12. Alternatively, each of the extensions 122 of the frame unit 10 is mounted on and extended downward from the armrests 14 or the seat. In the preferred embodiment of the present invention, the frame unit 10 includes four extensions 122. The backrest frame 11 of the frame unit 10 has a substantially U-shaped profile and has two first mounting holes 111 each pivotally connected with a respective one of the armrests 14. The footrest frame 13 of the frame unit 10 has a substantially U-shaped profile and has two second mounting holes 131 each pivotally connected with a respective one of the armrests 14. Each of the second connecting brackets 132 of the frame unit 10 is located under a respective one of the second mounting holes 131 of the footrest frame 13.

The frame unit 10 further includes a slide 15 slidably mounted on one of the armrests 14, a locking mechanism 151 mounted on the slide 15 and detachably locked onto on one of the armrests 14 to releasably lock the slide 15 onto on one of the armrests 14, and a link 152 having a first end pivotally connected with the slide 15 and a second end pivotally connected with the through hole 126 of the seat frame 12.

Figure 7:
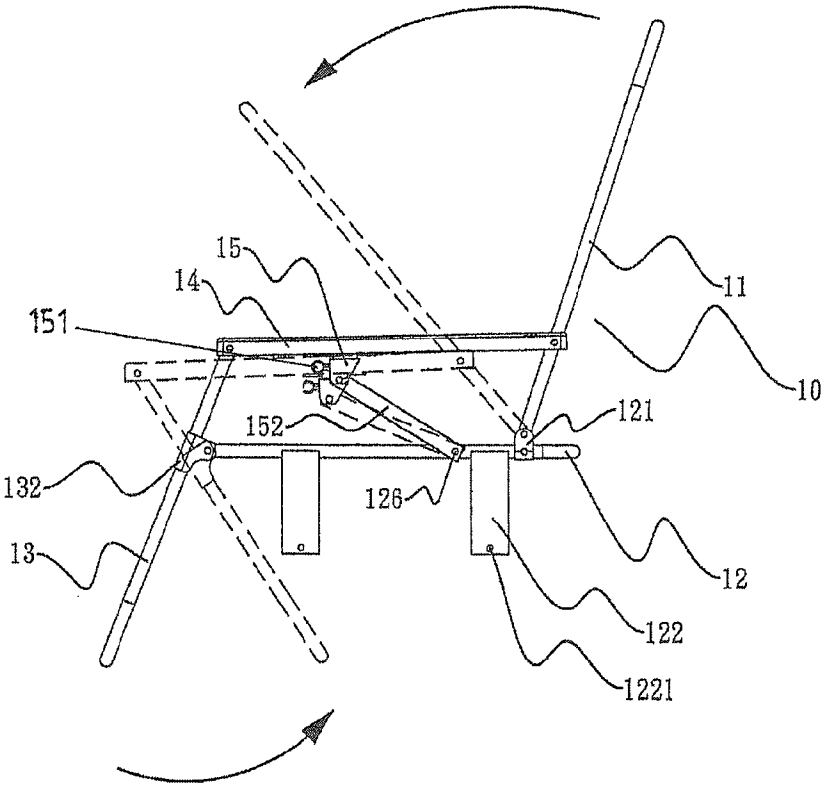
FIG. 7 is a side operational view of the frame unit of the rocking chair as shown in FIG. 6.

In adjustment, when the slide 15 is unlocked from one of the armrests 14 by the locking mechanism 151, the armrests 14 can be moved freely, so that the backrest frame 11 and the footrest frame 13 are pivoted relative to the seat frame 12 to adjust the inclined angle of each of the backrest frame 11 and the footrest frame 13 as shown in FIG. 7. At this time, the slide 15 slides on one of the armrests 14. After the inclined angle adjustment is accomplished, the slide 15 is again locked onto one of the armrests 14 by the locking mechanism 151.

The base unit 20 touches the ground and includes a first stand 22, a second stand 23 juxtaposed to the first stand 22, two mounting brackets 231 each mounted on the second stand 23 and each connected with the first stand 22, two support bars 21 connected with the first stand 22 and connected with the rocking members 30, and two linking levers 24 each connected between the second stand 23 and a respective one of the support bars 21.

Each of the support bars 21 of the base unit 20 has two second pivot holes 211 each connected with a respective one of the rocking members 30. Each of the support bars 21 of the base unit 20 has two opposite ends 210 each extended upward and disposed at an oblique position to increase the length of each of the rocking members 30. The second pivot holes 211 are formed in the two opposite ends 210 of each of the support bars 21 respectively. Each of the support bars 21 of the base unit 20 is provided with a first connecting hole 212 and a second connecting hole 213. The first connecting hole 212 of each of the support bars 21 is located at a height lower than that of the second connecting hole 213. The first connecting hole 212 and the second connecting hole 213 of each of the support bars 21 are located between the second pivot holes 211.

Figure 9:
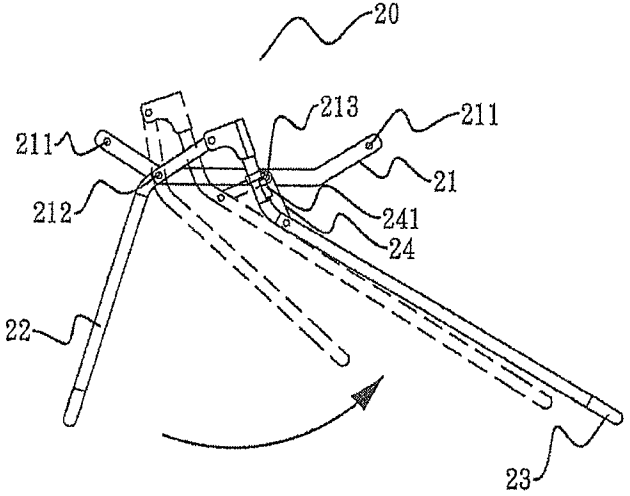
FIG. 9 is a side operational view of the base unit of the rocking chair as shown in FIG. 8.
Figure 8:
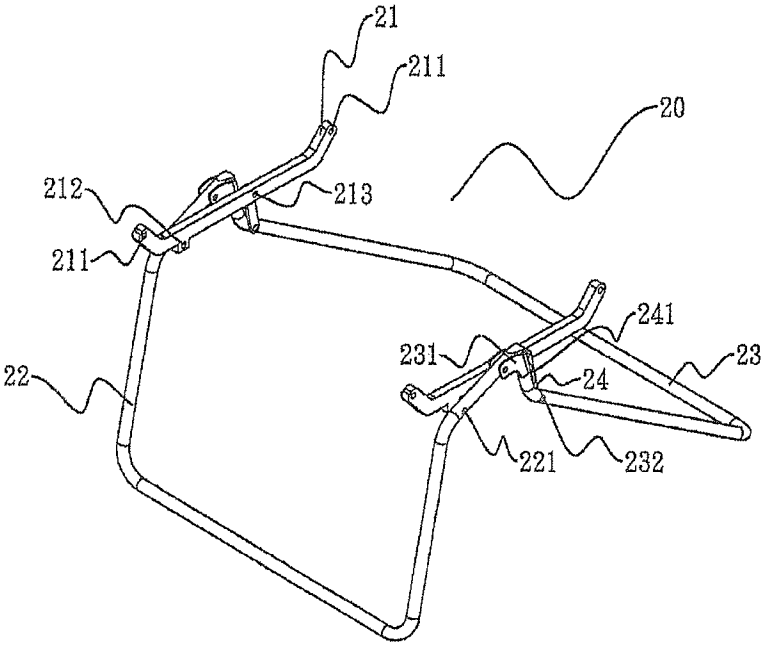
FIG. 8 is a perspective view of a base unit of the rocking chair as shown in FIG. 4.

The first stand 22 of the base unit 20 has a substantially U-shaped profile. The first stand 22 of the base unit 20 is provided with two third connecting holes 221 each connected with the first connecting hole 212 of a respective one of the support bars 21 by a rivet. The second stand 23 of the base unit 20 has a substantially U-shaped profile. The second stand 23 of the base unit 20 is provided with two fourth connecting holes 232 which is located under a respective one of the mounting brackets 231. Each of the linking levers 24 of the base unit 20 has a first end connected with the second connecting hole 213 of a respective one of the support bars 21 and a second end connected with a respective one of the fourth connecting holes 232 of the second stand 23 by a rivet. Each of the linking levers 24 of the base unit 20 is provided with a fixing portion 241 abutting the second stand 23 to position the second stand 23 when the base unit 20 is disposed at a fully expanded state as shown in FIG. 9.

Each of the rocking members 30 has a first end pivotally connected with the first pivot hole 1221 of a respective one of the extensions 122 and has a second end pivotally connected with a respective one of the second pivot holes 211 of each of the support bars 21. In the preferred embodiment of the present invention, the foldable rocking chair comprises four rocking members 30.

Figure 11:
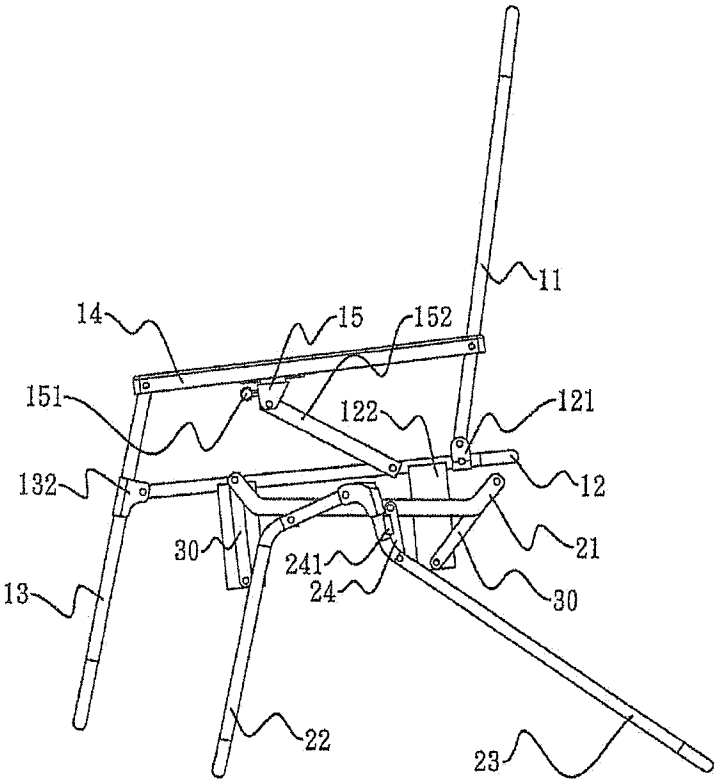
FIG. 11 is an operational view of the rocking chair as shown in FIG. 10.
Figure 10:
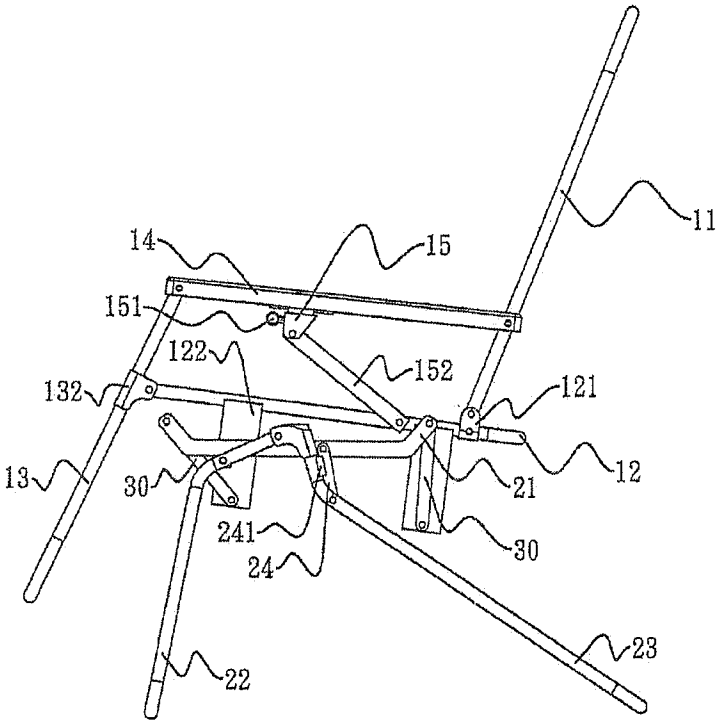
FIG. 10 is a side view of the rocking chair as shown in FIG. 4.

In operation, referring to FIGS. 10 and 11 with reference to FIGS. 4-9, each of the rocking members 30 is pivotally connected with the first pivot hole 1221 of the respective extension 122 and the respective second pivot hole 211 of each of the support bars 21, so that the frame unit 10 and the base unit 20 are connected by the rocking members 30. In such a manner, the frame unit 10 is rocked and swung forward and backward relative to the base unit 20 by pivoting motion of the rocking members 30 as shown in FIGS. 10 and 11. At this time, the slide 15 is locked onto one of the armrests 14 by the locking mechanism 151 to fix the inclined position of each of the backrest frame 11 and the footrest frame 13 as shown in FIG. 7, so that the inclined angle of each of the backrest frame 11 and the footrest frame 13 will not be changed during movement of the frame unit 10 relative to relative to the base unit 20. Alternatively, when the locking mechanism 151 is removed, the inclined angle of each of the backrest frame 11 and the footrest frame 13 will be changed freely during movement of the frame unit 10.

Figure 12:
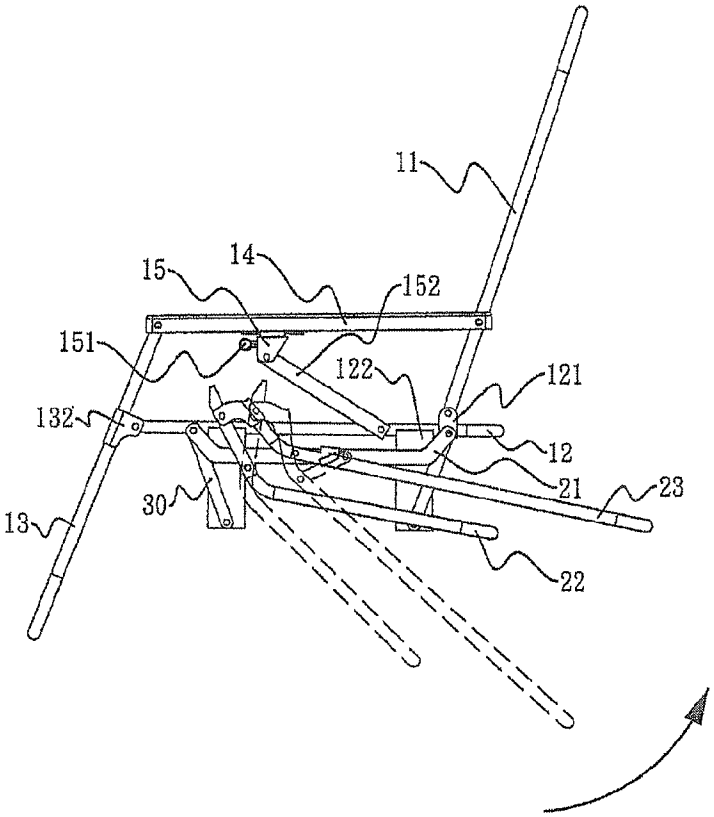
FIG. 12 is a partially folded view of the rocking chair as shown in FIG. 10.

Referring to FIG. 12 with reference to FIGS. 4-10, the first connecting hole 212 of each of the support bars 21 and each of the third connecting holes 221 of the first stand 22 function as a fulcrum of the first stand 22 so that the first stand 22 is capable of pivoting relative to the support bars 21. In such a manner, the first stand 22 is pivoted about the first connecting hole 212 of each of the support bars 21 and is moved toward the second stand 23. At the same time, the second stand 23 is driven and lifted by pivoting motion of the first stand 22 to drive the linking levers 24 upward so that each of the linking levers 24 is pivoted about the second connecting hole 213 of the respective support bar 21 and is moved toward the respective support bar 21 until the second stand 23 is almost parallel with the support bars 21. Thus, the second stand 23 is folded toward the support bars 21, and the first stand 22 is folded toward the second stand 23 so that the base unit 20 is folded as shown in FIG. 12.

Figure 13:
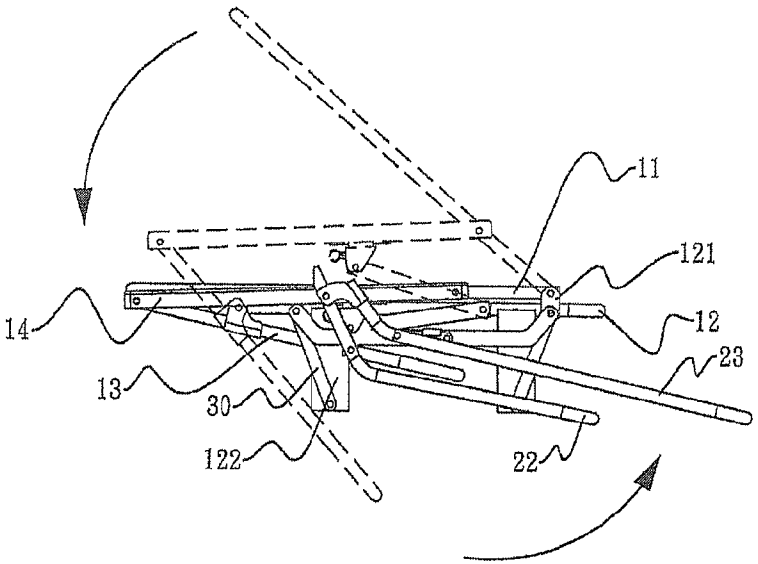
FIG. 13 is a fully folded view of the rocking chair as shown in FIG. 10.
Figure 14:
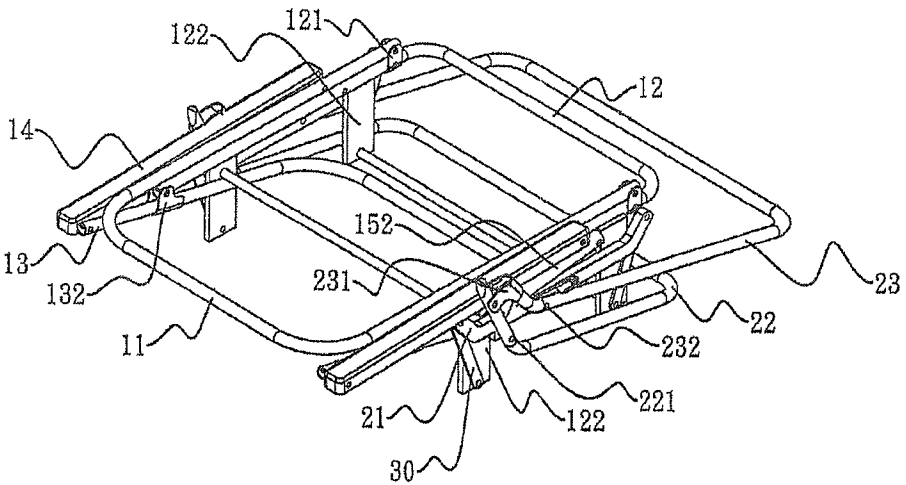
FIG. 14 is a fully folded view of the rocking chair as shown in FIG. 4

Referring to FIGS. 13 and 14 with reference to FIGS. 4-12, the backrest frame 11 is pivoted about the first connecting brackets 121 and is moved toward the seat frame 12. At the same time, the armrests 14 are pushed and moved forward by the backrest frame 11, and the footrest frame 13 is driven by the armrests 14, so that the footrest frame 13 is pivoted about the second connecting brackets 132 and is moved toward the seat frame 12. In such a manner, the backrest frame 11 is folded toward the seat frame 12, and the footrest frame 13 is folded toward the seat frame 12, so that the frame unit 10 is folded to have a flat structure as shown in FIGS. 13 and 14.

Figure 15:
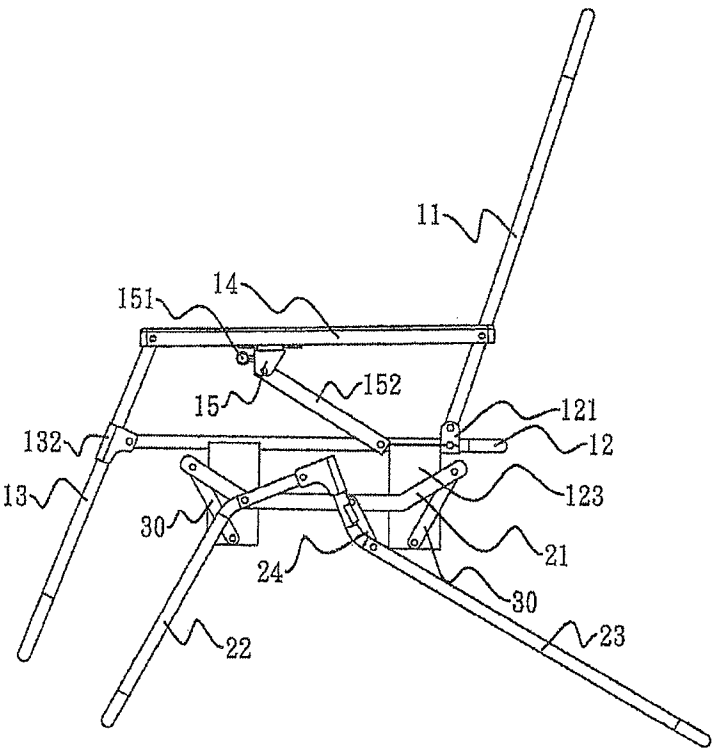
FIG. 15 is a side view of a rocking chair in accordance with another preferred embodiment of the present invention.

Referring to FIG. 15, each of the extensions 123 of the frame unit 10 is a sheet plate with an enlarged width, so that each of the extensions 123 and each of the rocking members 30 will not produce an angle therebetween during movement of the frame unit 10 relative to the base unit 20 to prevent the user from being clamped and to protect the user's safety.

Figure 16:
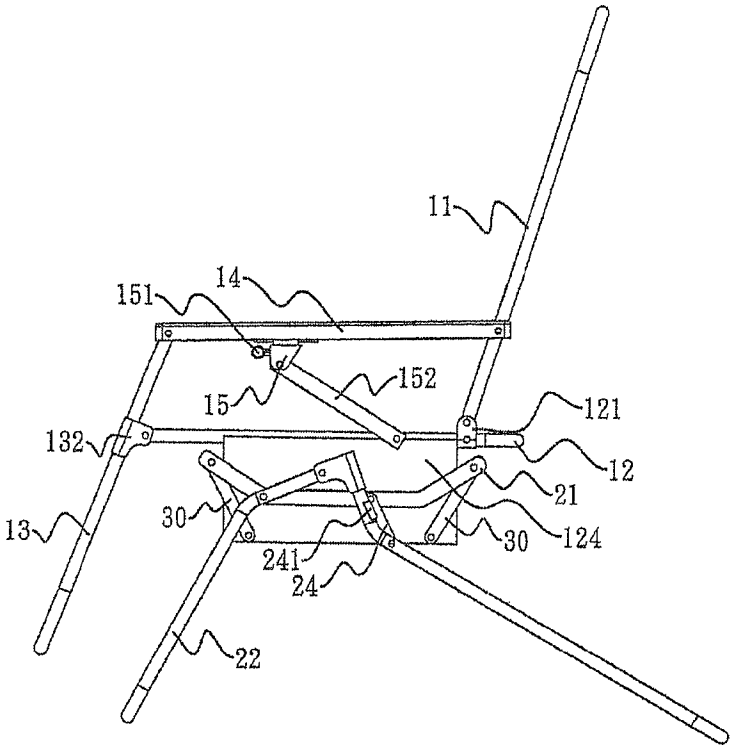
FIG. 16 is a side view of a rocking chair in accordance with another preferred embodiment of the present invention.

Referring to FIG. 16, each of the extensions 124 of the frame unit 10 is a sheet plate with an enlarged length, so that each of the extensions 124 and each of the rocking members 30 will not produce an angle therebetween during movement of the frame unit 10 relative to the base unit 20 to prevent the user from being clamped and to protect the user's safety.

Figure 17:
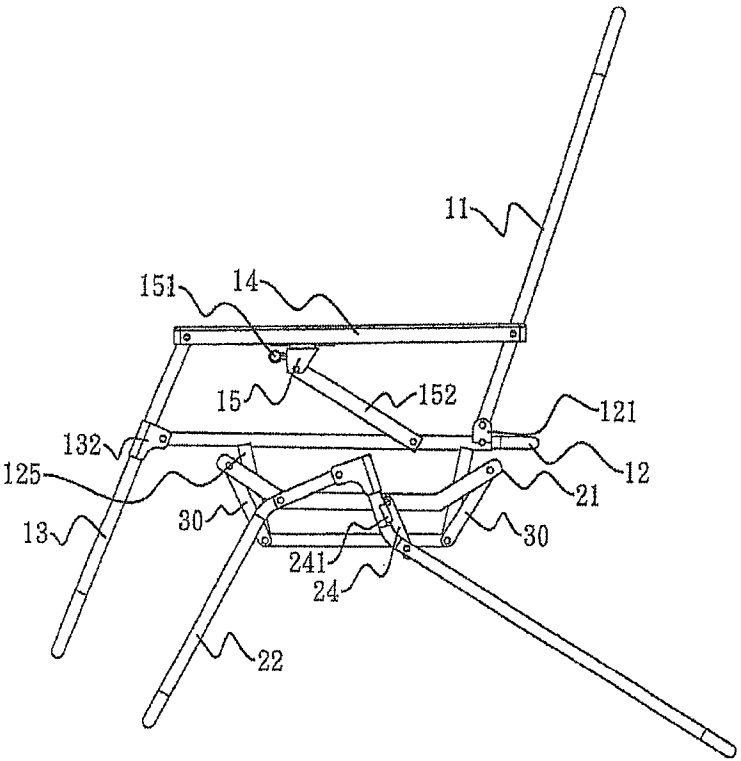
FIG. 17 is a side view of a rocking chair in accordance with another preferred embodiment of the present invention.

Referring to FIG. 17, each of the extensions 125 of the frame unit 10 has a frame shape.

Figure 18:
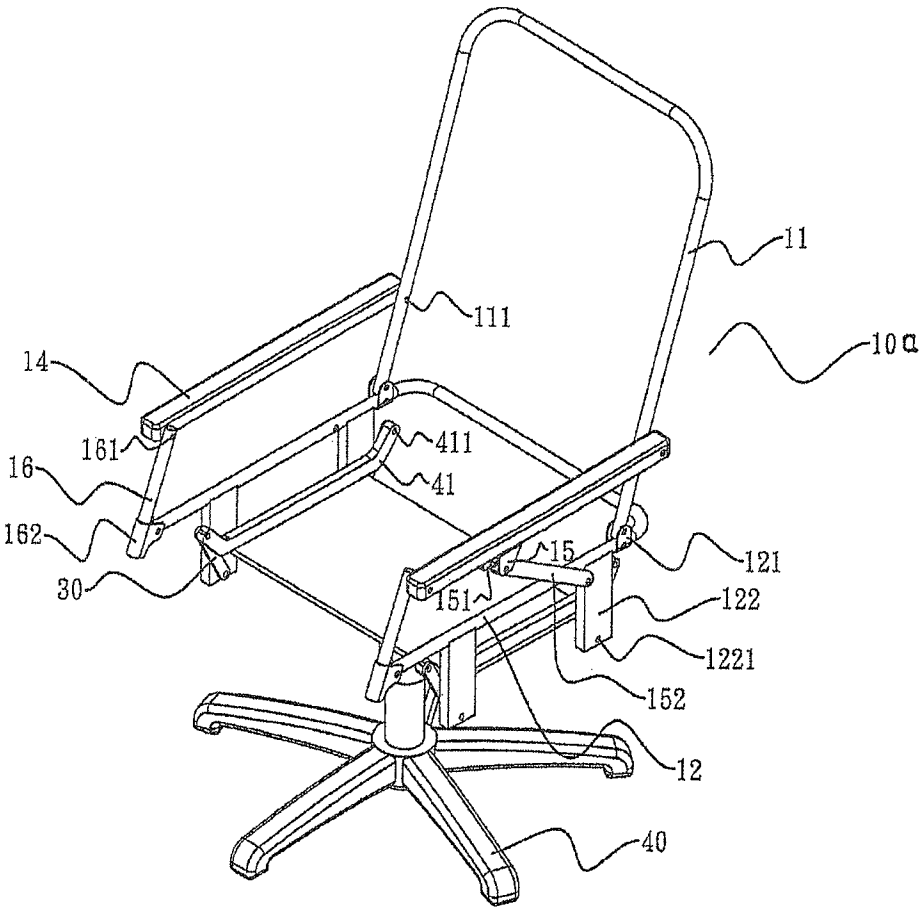
FIG. 18 is a perspective view of a rocking office chair in accordance with another preferred embodiment of the present invention.
Figure 20:
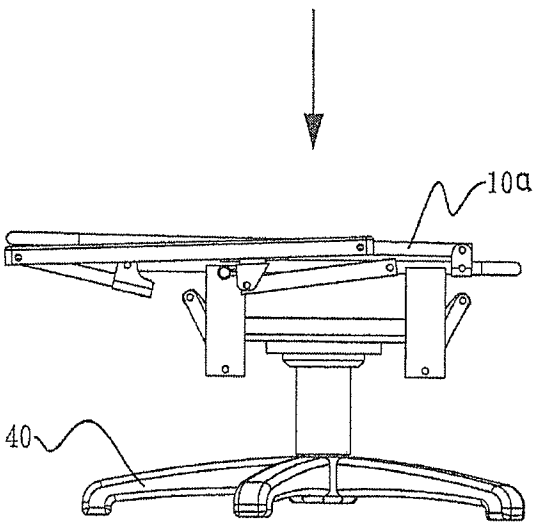
FIG. 20 is a folded view of the rocking office chair as shown in FIG. 19.
Figure 19:
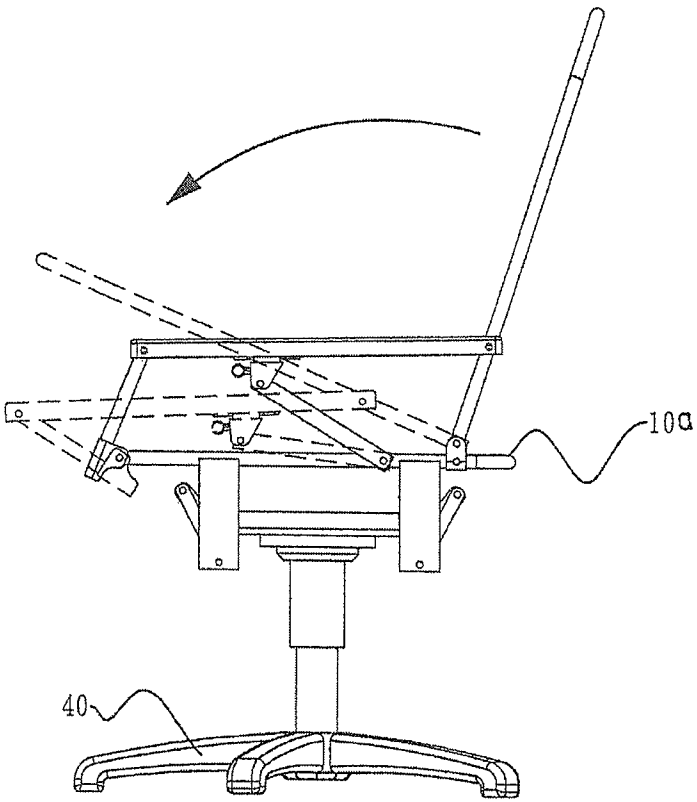
FIG. 19 is a side operational view of the rocking office chair as shown in FIG. 18.

Referring to FIGS. 18-20, the frame unit 10*a* is mounted on a base 40 of an office chair. The frame unit 10*a* includes two connecting rods 16 each connected with the seat frame 12, two second connecting brackets 162 each mounted on a respective one of the connecting rods 16 and each pivotally connected with the seat frame 12. Each of the connecting rods 16 has a second mounting hole 161 pivotally connected with a respective one of the armrests 14. Each of the support bars 41 is mounted on the base 40 and has two pivot holes 411 each connected with a respective one of the rocking members 30. Each of the rocking members 30 has a first end pivotally connected with the first pivot hole 1221 of a respective one of the extensions 122 and has a second end pivotally connected with a respective one of the pivot holes 411 of each of the support bars 41.

Accordingly, the frame unit 10 is rocked and swung forward and backward relative to the base unit 20 by pivoting motion of the rocking members 30, thereby providing a comfortable sensation to the user. In addition, the frame unit 10 is suspended above the base unit 20 and will not touch the ground during movement so that the frame unit 10 will not be worn or torn due to a frequent rubbing action. Further, the frame unit 10 and the base unit 20 are folded when not in use to reduce the whole volume of the rocking chair so as to facilitate packaging, transpiration and storage of the rocking chair. Further, the rocking chair is folded to facilitate the user carrying the rocking chair. Further, the inclined angle of the frame unit 10 can be adjusted freely to satisfy the user's practical requirement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A rocking chair comprising:

a base unit;

a frame unit located above the base unit; and a plurality of rocking members mounted between the base unit and the frame unit to connect the base unit and the frame unit, wherein:

the frame unit is suspended above the base unit and is capable of swinging forward and backward relative to the base unit;

the frame unit has an adjustable inclined angle;

the frame unit includes:

a seat frame;

a backrest frame connected with the seat frame;

two first connecting brackets each mounted on the seat frame and each pivotally connected with the backrest frame;

a footrest frame connected with the seat frame;

two second connecting brackets each mounted on the footrest frame and each pivotally connected with the seat frame;

two armrests each connected between the backrest frame and the footrest frame;

a plurality of extensions each connected with a respective one of the plurality of rocking members; and a seat mounted on the seat frame;

the backrest frame of the frame unit has two first mounting holes each pivotally connected with a respective one of the two armrests;

the footrest frame of the frame unit has two second mounting holes each pivotally connected with a respective one of the two armrests;

the base unit touches the ground and includes:

a first stand;

a second stand juxtaposed to the first stand;

two mounting brackets each mounted on the second stand and each connected with the first stand;

two support bars connected with the first stand and connected with the plurality of rocking members; and two linking levers each connected between the second stand and a respective one of the two support bars;

each of the two support bars of the base unit is provided with a first connecting hole and a second connecting hole;

the first stand of the base unit is provided with two third connecting holes each connected with the first connecting hole of a respective one of the two support bars;

the second stand of the base unit is provided with two fourth connecting holes;

each of the two linking levers of the base unit has a first end connected with the second connecting hole of a respective one of the two support bars and a second end connected with a respective one of the two fourth connecting holes of the second stand; and each of the two linking levers of the base unit is provided with a fixing portion abutting the second stand to position the second stand.

2. The rocking chair of claim 1, wherein:

each of the plurality of extensions of the frame unit is provided with a first pivot hole;

each of the two support bars of the base unit has two second pivot holes; and each of the plurality of rocking members has a first end pivotally connected with the first pivot hole of a respective one of the plurality of extensions and has a second end pivotally connected with a respective one of the two second pivot holes of each of the two support bars.

3. The rocking chair of claim 1, wherein:

the seat frame of the frame unit is provided with a through hole; and the frame unit further includes:

a slide slidably mounted on one of the two armrests;

a locking mechanism mounted on the slide and detachably locked onto on one of the two armrests to releasably lock the slide onto on one of the two armrests; and a link having a first end pivotally connected with the slide and a second end pivotally connected with the through hole of the seat frame.

4. The rocking chair of claim 1, wherein each of the plurality of extensions of the frame unit is mounted on and extended downward from the seat frame, the two armrests or the seat.

5. The rocking chair of claim 2, wherein:

each of the two support bars of the base unit has two opposite ends each extended upward and disposed at an oblique position to increase the length of each of the plurality of rocking members; and the two second pivot holes are formed in the two opposite ends of each of the two support bars respectively.

6. The rocking chair of claim 1, wherein each of the plurality of extensions of the frame unit is a sheet plate with an enlarged width or length or has a frame shape.

* * * * *